US007325276B2

(12) United States Patent
Kim

(10) Patent No.: US 7,325,276 B2
(45) Date of Patent: Feb. 5, 2008

(54) DETACHABLE DOOR HINGE DEVICE FOR VEHICLES

(75) Inventor: Sang Pill Kim, Incheon (KR)

(73) Assignee: GM Daewoo Auto & Technology Company, Incheon (KR)

( * ) Notice: Subject to any disclaimer, the term of this patent is extended or adjusted under 35 U.S.C. 154(b) by 188 days.

(21) Appl. No.: 11/076,801

(22) Filed: Mar. 10, 2005

(65) Prior Publication Data

US 2006/0174445 A1 Aug. 10, 2006

(30) Foreign Application Priority Data

Feb. 4, 2005 (KR) ..... 10-2005-0010397

(51) Int. Cl.
*E05D 7/10* (2006.01)

(52) U.S. Cl. ..... 16/262; 16/266

(58) Field of Classification Search ..... 16/262, 16/264, 265, 260, 266, 374, 381, 386, 387; 296/146.11, 146.12, 202
See application file for complete search history.

(56) References Cited

U.S. PATENT DOCUMENTS 3,068,508 A * 12/1962 Heyer ..... 16/386
4,372,703 A * 2/1983 Szostak ..... 403/324
4,542,558 A * 9/1985 Brockhaus ..... 16/263
4,715,090 A * 12/1987 Morris ..... 16/261
4,800,623 A * 1/1989 Brockhaus ..... 16/254
4,858,274 A * 8/1989 Harrison et al. ..... 16/265
4,881,298 A * 11/1989 Turnbull ..... 16/266
6,591,451 B2 * 7/2003 Gruber et al. ..... 16/262

FOREIGN PATENT DOCUMENTS

DE 3336802 A * 4/1985
DE 10116242 A1 * 11/2002
FR 2597915 A1 * 10/1987
GB 2181483 A * 4/1987
WO WO 03/012234 A1 2/2003

* cited by examiner

*Primary Examiner*—Chuck Y. Mah
(74) *Attorney, Agent, or Firm*—Hiscock & Barclay, LLP; Thomas R. FitzGerald, Esq.

(57) ABSTRACT

Disclosed herein is a detachable door hinge device for a vehicle. The door hinge device includes a first hinge portion protruded from a door bracket and having a hole for pivot connection formed inside thereof. A pivot pin is rotatably inserted into the hole for pivot connection. A latching groove is formed along the outer circumference of an intermediate region of the pivot pin. A second hinge portion is formed in a body bracket and has a pivot pin hole formed therein for inserting the latching groove region of the pivot pin thereto. The pivot pin hole has a serration formed so as to fit to the serrated portion. A control pin hole is formed in the second hinge portion perpendicularly to the pivot pin hole. A control pin is inserted rotatably into the control pin hole in order to control an axial movement of the pivot pin.

15 Claims, 7 Drawing Sheets

DETACHABLE DOOR HINGE DEVICE FOR VEHICLES

CROSS-REFERENCE TO RELATED APPLICATIONS

This application claims the benefit of the filing date of Korean Patent Application No. 10-2005-010397 filed Feb. 4, 2005.

BACKGROUND OF THE INVENTION

1. Field of the Invention

The present invention relates to a door hinge device for a vehicle, which can be easily assembled and disassembled, and provide a higher degree of safety during the use.

2. Background of the Related Art

FIG. 1 is a perspective view of a conventional door hinge device for a vehicle. As shown in FIG. 1, the conventional door hinge device for a vehicle includes a body bracket 1, a door bracket 3, and a hinge pin 4 for coupling the body bracket and the door bracket to each other. Each bracket 1, 3 has a hole 2, 5 for bolt fastening. Such a door hinge device guides opening and closing of a door, and include a device for restricting the maximum opening angle in order to prevent interference with the outer panel of a car body.

In case of this conventional door hinge device, two devices are used for every door, and thus total eight hinge devices are required in a car having four doors. In addition, four bolts are used for each hinge device and therefore thirty-two bolts are needed in total. However, the assembling process is not completed with the above 32 times of bolt fastening, due to the reasons as follows.

During the car assembling process, when a body frame and a doorframe are completed, thirty-two bolts are to be fastened in order to install four doors in the car body. Next, a painting process is carried out and then half of the fastened bolts, sixteen bolts, are removed to thereby detach the door.

To the car body with the doors detached are assembled various interior materials such as a seat and a handle, while passing through a body assembling line. The detached door is assembled with a door trim, a rear view mirror and the like, through a door assembling line. Thereafter, at the meeting point of the body assembling line and the door assembling line, the door is assembled again to the car body. At this time, the above sixteen bolts are fastened again to the door bracket and the body bracket. In order to fasten the bolts, an impact ranch is in common used, and thus the paint coat in the bolt head is partly damaged or peeled off due to impact of the ranch. This damaged portion causes corrosion and allows the corrosion to be concentrated thereto. Therefore, an operator must repair the damaged paint portions in the bolt head, through a brush painting to finish the assembling process. Total 48 times of bolt fastening, 16 times of bolt removing, and a manual brush-painting work must be associated with the car assembling line.

As described above, the mode of detaching and attaching again a door is applied to a general car assembling process, but not to that of a particular car manufacturer. Therefore, carmakers worldwide have made various attempts in order to solve these irrational points in the car assembling process. For example, Korean Patent Laid-open Publication No. 2004-43014 discloses a car door hinge which can be easily attached and detached, and Korean Patent Laid-open Publication No. 2004-18311 discloses a car door hinge device where a pivot is structurally integrated. However, these approaches do not become a complete solution over the above problems in the art, and involve many wasteful procedures in the current door hinge assembling processes.

SUMMARY OF THE INVENTION

Therefore, the present invention has been made in view of the above problems occurring in the prior art, and it is an object of the present invention to provide a door hinge device for a vehicle, which can be easily assembled and disassembled.

Another object of the invention is to provide a door hinge device for a vehicle, which can restrict the maximum opening angle of a door, along with an easy assembling and disassembling.

A further object of the invention is to provide a door hinge device for a vehicle, which can be easily checked up if it is appropriately coupled at the right position.

A further object of the invention is to provide a door hinge device for a vehicle, which can be assembled without necessity of using an impact ranch, thereby preventing damage of a paint coat while being assembled.

To accomplish the above object, according to one embodiment of the present invention, there is provided a detachable door hinge device for a vehicle. The door hinge device includes: a) a door bracket and a body bracket pivotally coupled with the door bracket; b) a first hinge portion protruded from the door bracket and having a hole for pivot connection formed inside thereof; c) a pivot pin rotatably inserted into the hole for pivot connection and having a latching groove formed along the outer circumference of an intermediate region thereof and a serrated portion formed at one end thereof, the latching groove being depressed so as to have a semi-circular cross-section; d) a second hinge portion installed in the body bracket, the second hinge portion having a pivot pin hole formed therein for inserting the latching groove region of the pivot pin thereto and a control pin hole formed therein in such a manner as to be arranged perpendicular to the pivot pin hole thereof, part of the control pin hole being fluid-communicated with the pivot pin hole thereof, the pivot pin hole having a serration formed therein so as to fit to the serrated portion of the pivot pin; and e) a control pin inserted rotatably into the control pin hole for controlling an axial movement of the pivot pin depending on a rotated position thereof.

Preferably, the serrated portion of the pivot pin may be tapered.

The tapered shape of the serrated portion is contoured in such a way that the diameter thereof is gradually decreased towards an end portion thereof so as to easily insert the serrated portion into the pivot pin hole.

The pivot pin is provided with a latching projection formed on the outer circumference of the intermediate area thereof, the latching projection having a diameter larger than the inner diameter of the pivot pin hole.

Preferably, the latching projection is uniformly formed along the outer circumference of the pivot pin.

The control pin comprises: a head exposed outside of the control pin hole; a projection of a certain desired height protruded from a certain point of the circumference of the head; and a cylinder portion extended from the head in its axial direction and having a cut portion formed by cutting out a portion thereof.

The diameter of the cylinder portion is equal to or less than the depressed diameter of the latching groove of the pivot pin.

The control pin hole has a stopper formed one side thereof for designating a first rotation position of the projection, which rotates integrally with the head.

In addition, the control pin hole has a stopper formed one side thereof for designating a second rotation position of the projection, which rotates integrally with the head.

The control pin hole has a projection guide face formed at one side thereof, which is depressed so as to have a diameter larger than a revolution diameter of the projection. The first rotation position is defined by a release stopper formed at one position on the circumference of the projection guide face for detaching and releasing the pivot pin. The second rotation position is defined by a locking stopper formed another position on the circumference of the projection guide face for locking the pivot pin.

The cut portion is formed to face the pivot pin hole, when the projection is placed at the position of the release stopper.

The pivot pin is provided with a first washer connected to one end thereof, and the control pin is provided with a second washer connected to one end thereof.

Furthermore, the pivot pin has a serrated portion formed in the lower end portion thereof for restricting a relative rotation of the pivot pin and the second hinge portion, and the pivot pin hole has a serration formed in the inner diameter thereof so as to be engaged with the serrated portion.

The first hinge portion has a first stopper protruded in a rotating direction of a door, and the second hinge portion has a second stopper protruded so as to butt the first stopper and thus limit a rotating angle of the door.

That portion of the second hinge portion that contacts the first hinge portion forms partially a rotation guide face having the shape of a concave curved surface. The first hinge portion has a third stopper protruded in such a manner as to rotate while approaching the rotation guide face without interference.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

The preferred embodiments of the invention will be hereafter described in detail, with reference to the accompanying drawings.

Figure 1:
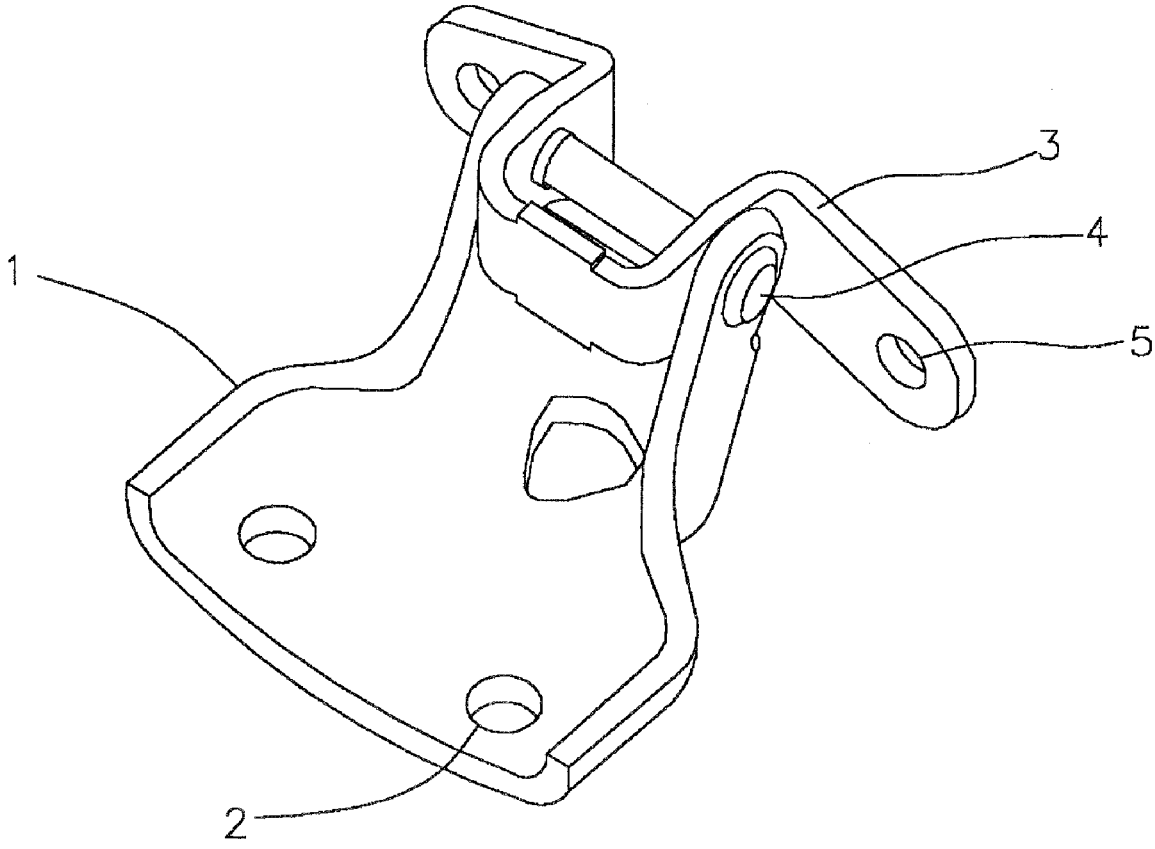
FIG. 1 Prior Art
FIG. 1 is a perspective view of a conventional door hinge device for a vehicle.
Figure 2:
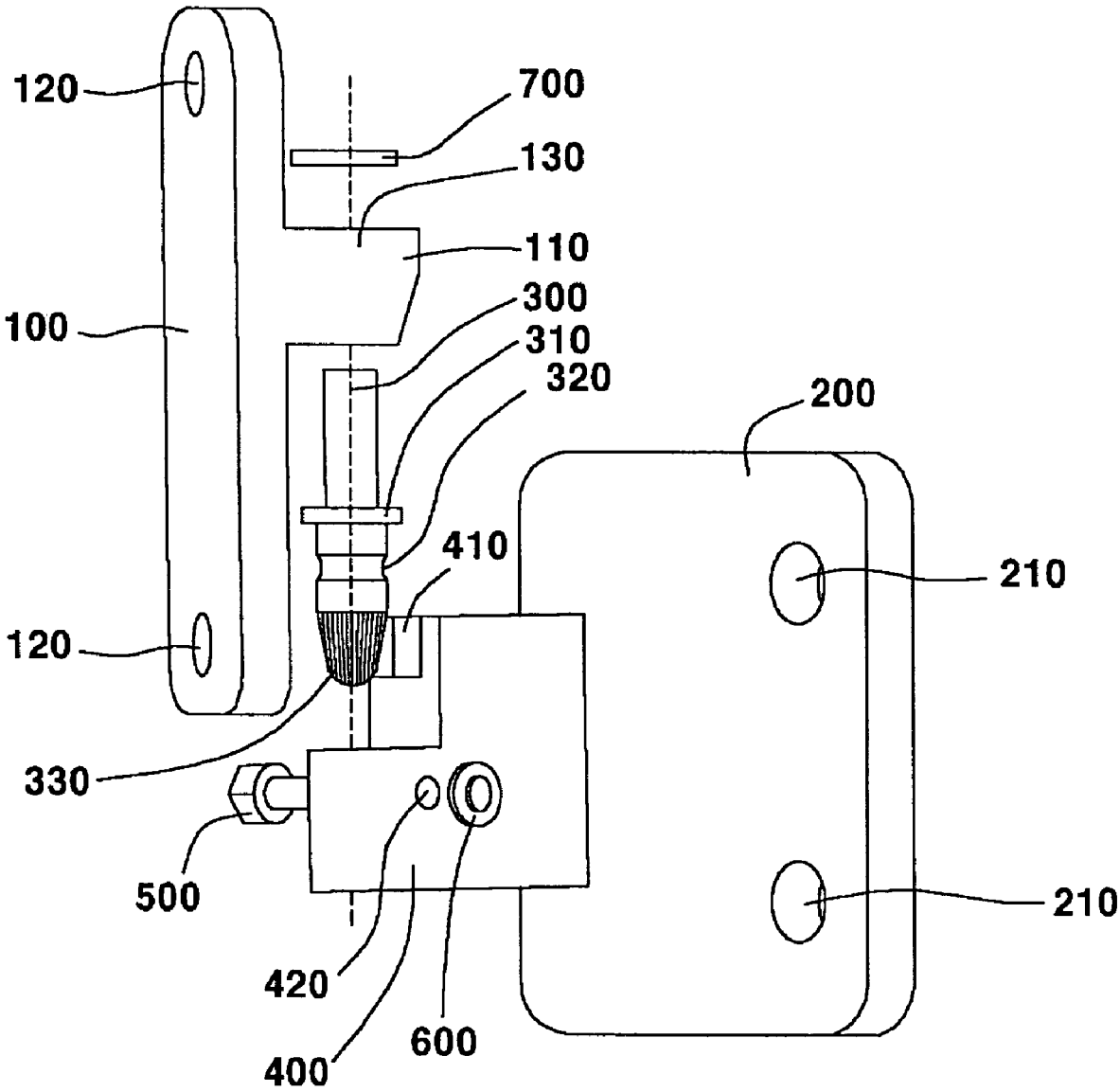
FIG. 2 is an exploded perspective view of a detachable door hinge device for a vehicle according to the present invention.
Figure 3:
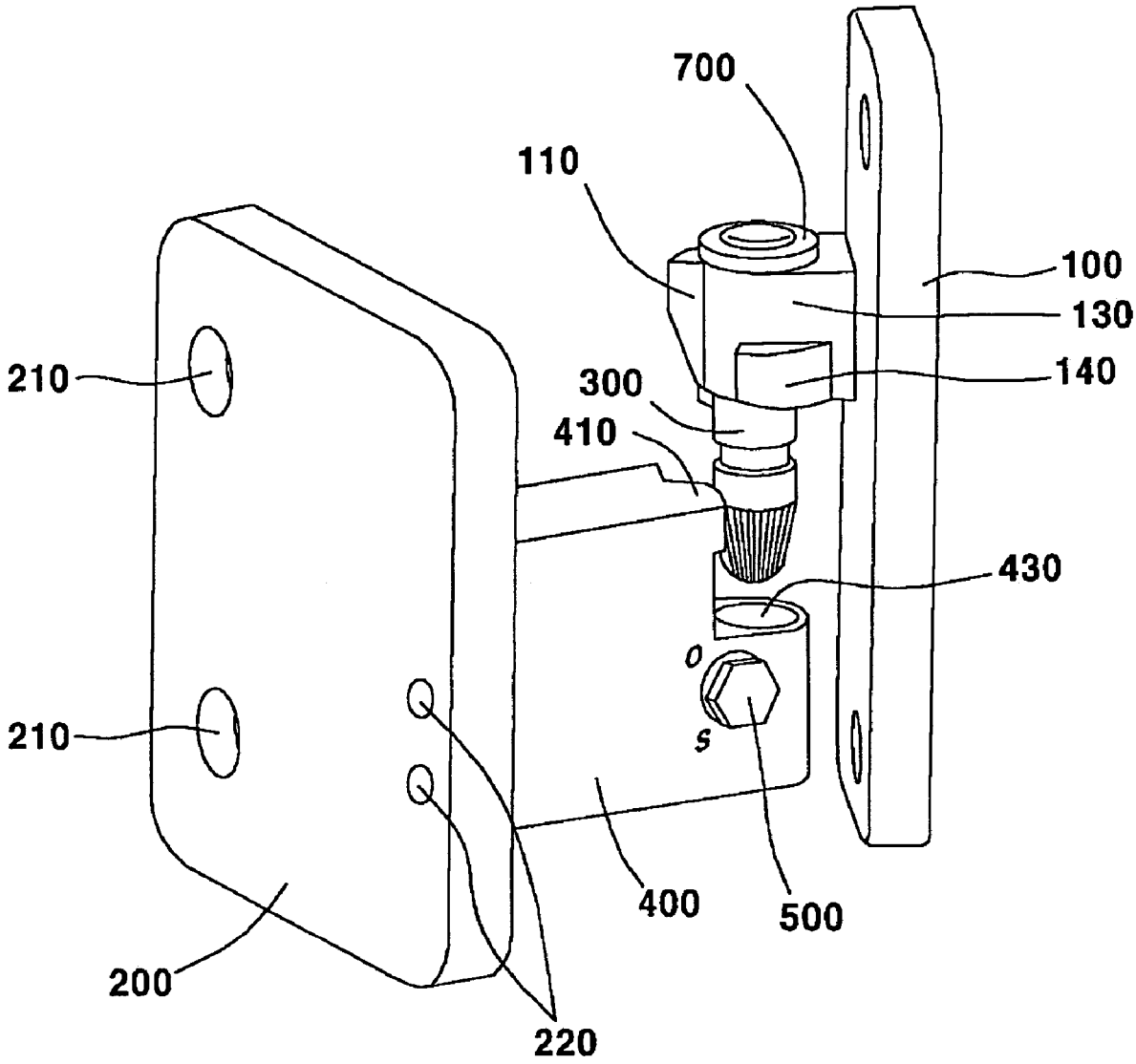
FIG. 3 is an exploded perspective view of the detachable door hinge device of FIG. 2 where a body bracket and a door bracket have been assembled.
Figure 4:
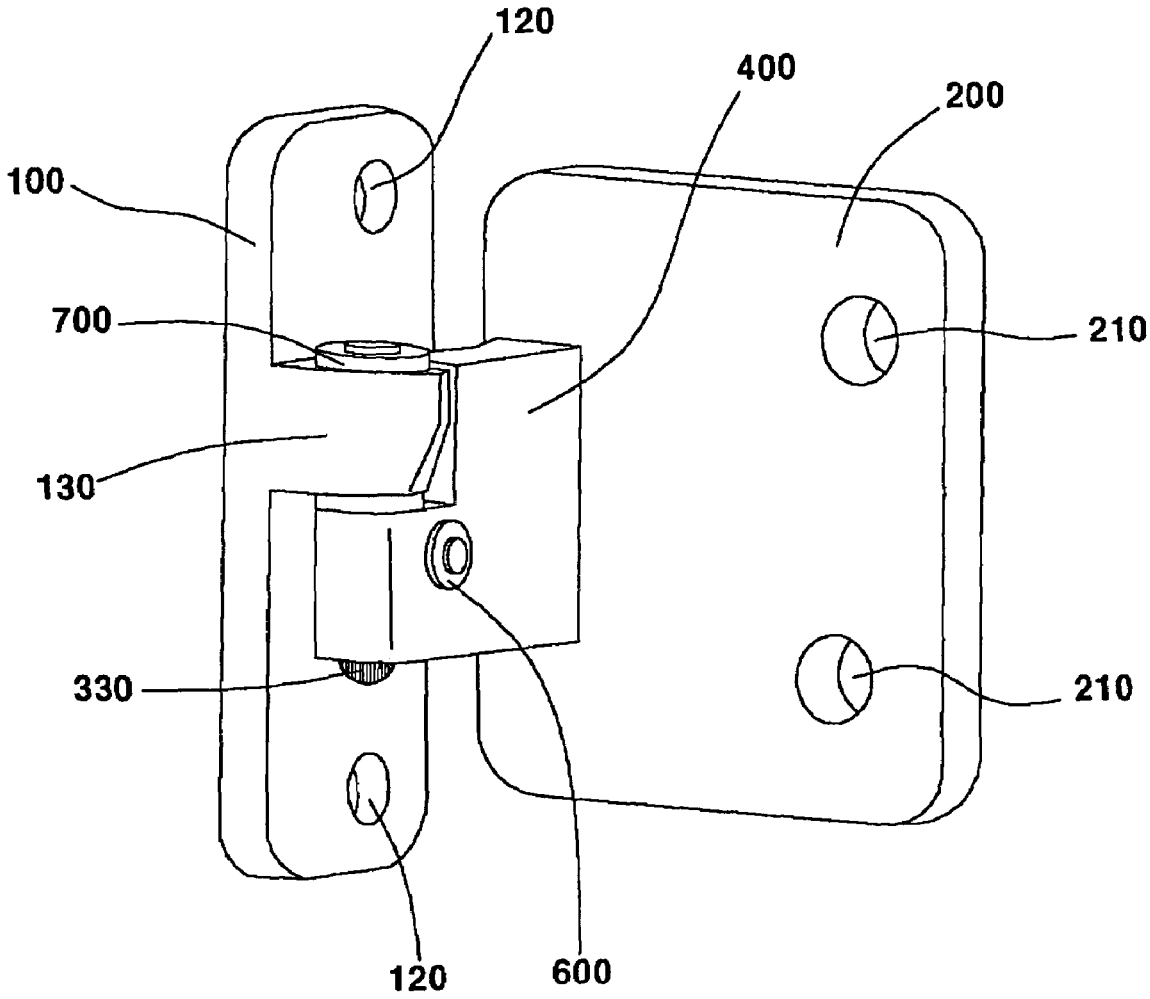
FIG. 4 is a frontal perspective view of the detachable door hinge device of FIG. 3 where the door is open.
Figure 5:
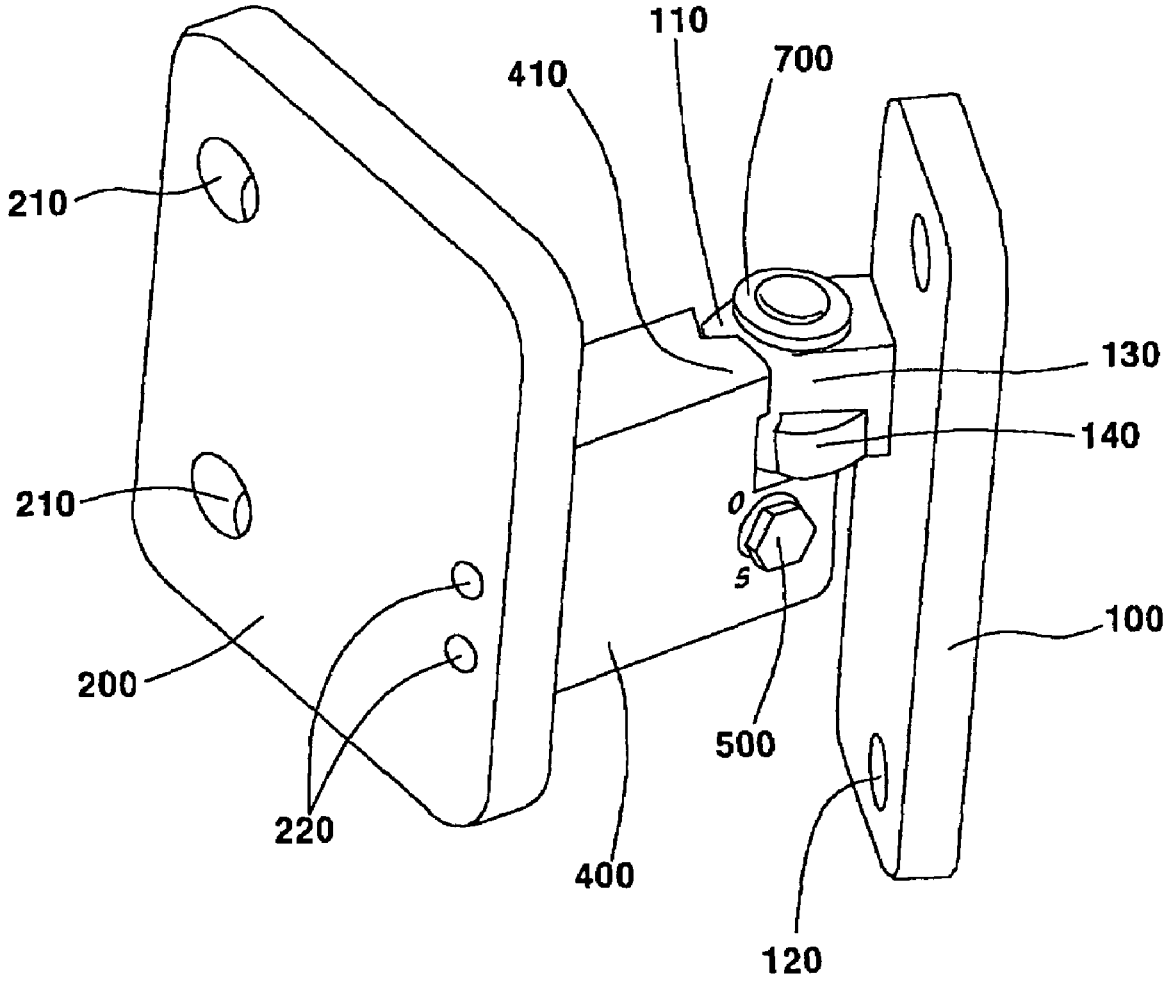
FIG. 5 is a perspective rear view of the detachable door hinge device shown in FIG. 4.

FIG. 2 is an exploded perspective view of a detachable door hinge device for a vehicle according to the present invention. FIG. 3 is an exploded perspective view of the detachable door hinge device of FIG. 2 where a body bracket 200 and a door bracket 100 have been assembled. FIG. 4 is a frontal perspective view of the detachable door hinge device of FIG. 3 where the door is open. FIG. 5 is a perspective rear view of the detachable door hinge device shown in FIG. 4.

As illustrated in FIGS. 2 to 5, the door hinge device generally includes a door bracket 100, a first hinge portion 130, a pivot pin 300, a body bracket 200, a second hinge portion 400, and a control pin 500.

The door bracket 100 is to be fixed to a door side and has a hole 120 formed at the upper and lower portions for a bolt fastening. The first hinge portion 130 is protruded toward the hinge side integrally from the door bracket.

The first hinge portion 130 is protruded from and formed integrally with the door bracket 100, and has a bore (not given a reference numeral) formed such that the pivot pin 300 passes through in the axial direction of the hinge. The first hinge portion 130 has a first stopper 110 protruded from and formed at the circumference thereof. The first stopper 110 is configured such that the maximum opening angle of the door can be limited by abutting against the second stopper 410.

At the circumference is formed a third stopper at a position below the first stopper 110. This third stopper 140 is revolved along a rotation guide face 450 and closely contacted therewith. Therefore, in the case where either one of the door bracket 100 and the pivot pin 300 is not assembled at its right position, the third stopper 140 is configured so as to collide with the rotation guide face 450 and thus the door cannot be rotated. Therefore, when assembled, a failure of the hinge engagement can be easily found simply by checking up the rotating state of the door.

The pivot pin 300 is assembled in a vertical direction and has generally a cylinder-like shape. The upper portion of the pivot pin 300 is rotatably inserted into the first hinge portion 130. The pivot pin 300 has a latching projection 310 having a uniform cross-section formed at the intermediate region thereof and along the circumference thereof. Since the outer diameter of the latching projection 310 is larger than the inner diameter of the pivot pin hole 430, as shown in FIG. 4, the latching projection 310 appears as if it is squeezed between the first hinge portion 130 and the second hinge portion 400 when assembled.

At the upper end of the pivot pin 300 is installed a first washer 700. The first washer 800 functions to prevent the pivot pin 300 from releasing from the first hinge portion 130, while allowing a free rotation of the pivot pin 300.

Below the latching projection 310 is formed a latching groove 320 having a semi-circular cross-section. The latching groove 320 interferes with the control pin 500.

The lower end of the pivot pin 300 is formed of a taper, which has a serrated portion 330 formed in the surface thereof. The serrated portion 330 is engaged with a serration formed in the inner diameter of the second hinge portion 400. This serration allows the pivot pin 300 to be easily assembled and disassembled in its axial direction, and simultaneously, when assembled, the pivot pin 300 and the second hinge portion 400 to be integrally rotated.

The body bracket 200 is a member to be fixed to the body of a vehicle and has two holes 210 formed for a bolt fastening. In addition, the body bracket 200 has two holes 220 for a bolt connection with the second hinge portion 400. As illustrated, the body bracket 200 and the second hinge portion 400 may be separately formed and assembled together using a bolt, and also may be formed in an integral piece without the hole 220 for bolt fastening.

Figure 6:
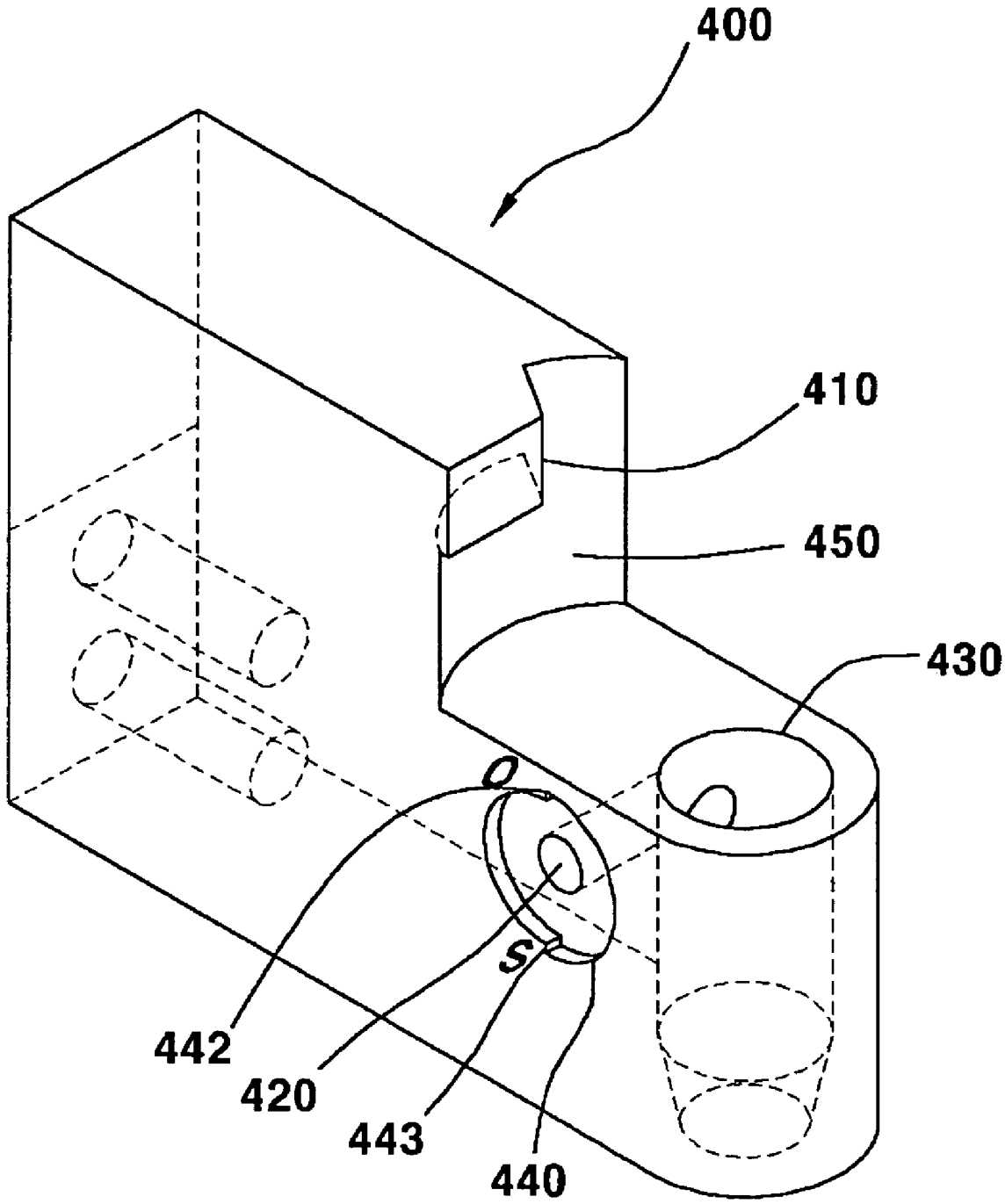
FIG. 6 is a perspective view of a second hinge portion used in the present invention.

FIG. 6 is a perspective view of a second hinge portion 400 used in the present invention. As shown in FIG. 6, the second hinge portion includes a pivot pin hole 430, a second stopper 410, a control pin hole 420, a release stopper 442, a locking stopper 443, a projection guide face 440, and the like.

The pivot pin hole 430 is fluid-communicatively formed vertically in the end region of the second hinge portion 400. A pivot pin 300 is inserted into the pivot pin hole 430. The pivot pin hole 430 has a taper and a serrated portion formed inside thereof.

The control pin hole 420 is fluid-communicatively formed perpendicular to the pivot pin hole 430 (seen from FIG. 6), and the intermediate region thereof is fluid-communicated with the pivot pin hole 430.

At one side of the control pin hole 420 is formed the projection guide face 440 depressed in such a manner that the head 510 of the control pin 500 can be accommodated and rotated. In the upper portion of the projection guide face 440 is positioned the release stopper 442, and in the lower portion thereof is positioned the locking stopper 443. The release stopper 442 and the locking stopper 443 make an angle of 180~270 degrees on the projection guide face 440.

In the cut portion of the second hinge portion 400 is formed a rotation guide face 450 depressed in an arcuate form, and the second stopper 410 is projected in the upper midway position of the rotation guide face 450.

Figure 7:
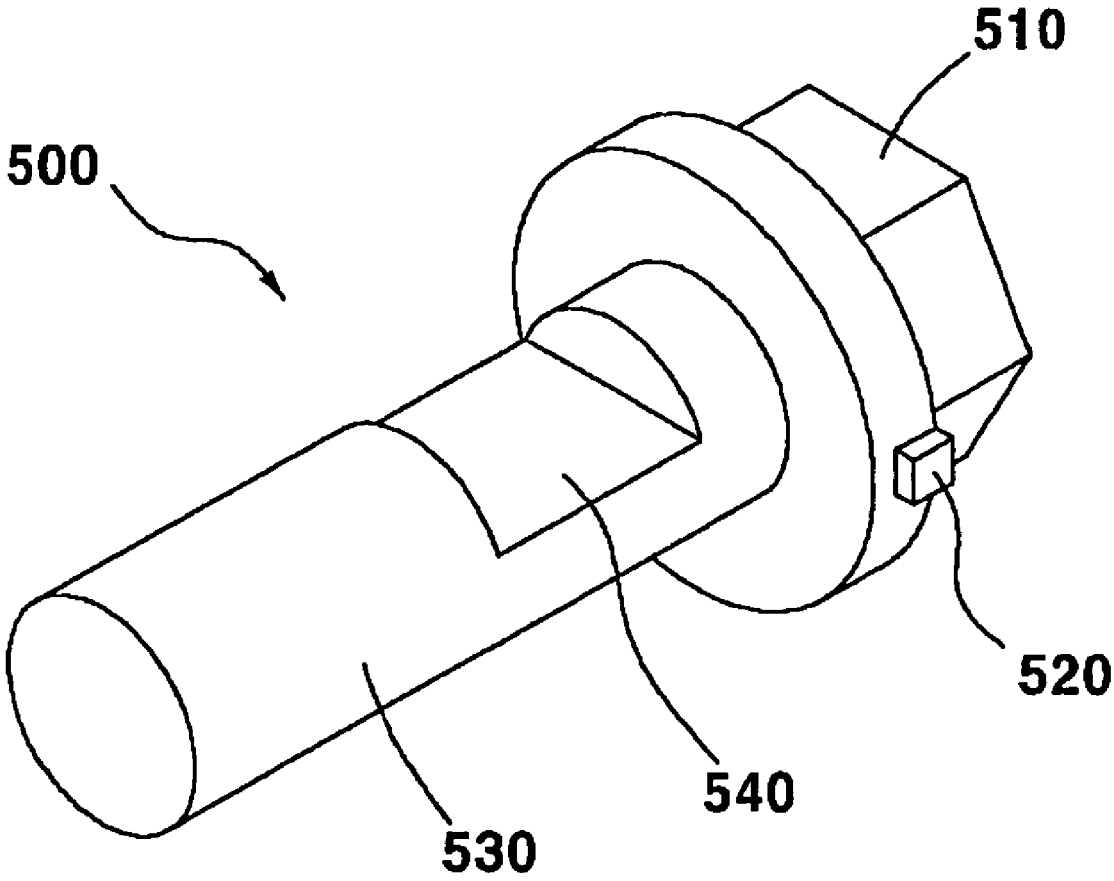
FIG. 7 is a perspective view of a control pin used in the present invention.

FIG. 7 is a perspective view of a control pin 500 used in the present invention. As illustrated in FIG. 7, the bolt-like control pin 500 has a head 510 formed at one end thereof, and a projection 520 is formed at the circumference of the head 510. At the other end of the control pin 500 is formed a cylinder portion 530. The control pin 500 is rotatably inserted into the control pin hole 420, and a second washer 600 is assembled to the end portion of the cylinder portion 530. The cylinder portion 530 is formed so as to have a diameter equal to or less than that of the latching groove 320 of the pivot pin 300. The cylinder portion 530 has a cut portion 540 formed approximately in the intermediate area so as to have a flat cut surface.

Hereafter, the assembling and disassembling, and operation of the door hinge device having the above-described constitution will be explained.

First, as seen from FIG. 2, the pivot pin 300 passes through the first hinge portion 130 and is fixed by means of the first washer 700. Then, the control pin 500 is inserted into the control pin hole 420 and fixed by means of the second washer 600. Thereafter, the control pin 500 is rotated in such a way that the projection 520 thereof is placed at the release stopper 442. Then, the cut portion 540 of the control pin 500 is exposed to the inside of the pivot pin hole 430 and the pivot pin 300 can be freely moved in the vertical direction. At this time, the pivot pin 300, which is assembled with a door (not illustrated) and the door bracket 100, is inserted into the pivot pin hole 430 and advanced until when the serrated portion 330 is engaged.

Next, the projection 520 is rotated along the projection guide face 440 up to the locking stopper 443. Then, the cut portion 540 is rotated inside the control pin hole 420 such that the round cylinder portion 530 is exposed to the inside of the pivot pin hole 430. Then, the exposed portion of the cylinder portion 530 is inserted into the latching groove 320 of the pivot pin 300. In this way, the assembling of the door hinge device is completed. That is, an assembling person can finish the assembling work by connecting the first and second washer 700, 600 with each pin, assembling the pivot pin 300, and then turning the control pin 500.

After paining during the assembling process, when required to be disassembled, the projection 520 is turned up to the release stopper 442 and then the door and the door bracket 100 is removed therefrom to thereby finish the disassembling. In addition, at the end of assembling process, when the finished door is to be reattached, the pivot pin 300 assembled with the door bracket 100 is inserted into the pivot pin hole 430 and the projection 520 is rotated until the locking stopper 443. If the pivot pin 300 is not inserted properly into the pivot pin hole 430, the third stopper 140 is collided with the rotation guide face 450 and thus the door cannot be opened. That is, this can be easily recognized to the assembling person.

As shown in FIG. 5, when the door is opened at the assembled state, the first stopper 110 and the second stopper 410 butt with each other to thereby restrict a further rotation. Therefore, the maximum opening angle can also be limited.

Therefore, as described above, according to one embodiment of the invention, the assembling and disassembling of the door hinge device for a vehicle can be easily carried out. It leads to omission of unnecessary processes and reduction in the labor cost.

In addition, since the maximum opening angle of a door can be restricted, the outer panel of vehicles can be protected and, during the assembling process, the door hinge device can be easily check up whether it is assembled at the right position. Therefore, the quality assurance can be effectively performed, along with the speedy assembling.

In addition, the assembling and disassembling process can be carried out without necessity of using an impact ranch, so that the coating film can be prevented from damage while assembling and disassembling the door hinge and enabling omission of a brush-painting process.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A detachable door hinge device for a vehicle, the door hinge device comprising:

a) a door bracket and a body bracket pivotally coupled with the door bracket;

b) a first hinge portion protruded from the door bracket and having a hole for pivot connection formed inside thereof;

c) a pivot pin rotatably inserted into the hole for pivot connection and having a latching groove formed on the outer circumference of an intermediate region thereof and a serrated portion formed at a lower end thereof, the latching groove being depressed so as to have a semi-circular cross-section;

d) a second hinge portion installed in the body bracket, the second hinge portion having a pivot pin hole formed therein for inserting the latching groove region of the pivot pin thereto and a control pin hole formed therein in such a manner as to be arranged perpendicular to the pivot pin hole thereof, part of the control pin hole being fluid-communicated with the pivot pin hole thereof, the pivot pin hole having a serration formed therein so as to fit to the serrated portion of the pivot pin; and e) a control pin inserted rotatably into the control pin hole for controlling an axial movement of the pivot pin depending on a rotated position of the control pin, the control pin having a cylinder portion defining a cut portion on one side thereof, wherein the angular position of the cut portion controls the axial movement of the pivot pin.

2. The door hinge device according to claim 1, wherein the serrated portion of the pivot pin is tapered.

3. The door hinge device according to claim 2, wherein the tapered shape of the serrated portion is contoured in such a way that the diameter thereof is gradually decreased towards one end portion thereof so as to easily insert the serrated portion into the pivot pin hole.

4. The door hinge device according to claim 1, wherein the pivot pin is provided with a latching projection formed on the outer circumference of the intermediate area thereof, the latching projection having a diameter larger than the inner diameter of the pivot pin hole.

5. The door hinge device according to claim 4, wherein the latching projection is uniformly formed along the outer circumference of the pivot pin.

6. The door hinge device according to claim 1, wherein the pivot pin is provided with a first washer connected to one end thereof, and the control pin is provided with a second washer connected to one end thereof.

7. The door hinge device according to claim 1, wherein the first hinge portion has a first stopper protruded in a rotating direction of a door, and the second hinge portion has a second stopper protruded so as to butt the first stopper and thus limit a rotating angle of the door.

8. The door hinge device according to claim 7, wherein a portion of the second hinge portion that contacts the first hinge portion forms partially a rotation guide face having the shape of a concave curved surface, and the first hinge portion has a third stopper protruded in such a manner as to rotate while approaching the rotation guide face without interference.

9. The door hinge device according to claim 1, the control pin being moveable between a first angular position and a second angular position within the control pin hole.

10. A detachable door hinge device for a vehicle, the door hinge device comprising:

a) a door bracket and a body bracket pivotally coupled with the door bracket;

b) a first hinge portion protruded from the door bracket and having a hole for pivot connection formed inside thereof;

c) a pivot pin rotatably inserted into the hole for pivot connection and having a latching groove formed on the outer circumference of an intermediate region thereof and a serrated portion formed at a lower end thereof, the latching groove being depressed so as to have a semi-circular cross-section;

d) a second hinge portion installed in the body bracket, the second hinge portion having a pivot pin hole formed therein for inserting the latching groove region of the pivot pin thereto and a control pin hole formed therein in such a manner as to be arranged perpendicular to the pivot pin hole thereof, part of the control pin hole being fluid-communicated with the pivot pin hole thereof, the pivot pin hole having a serration formed therein so as to fit to the serrated portion of the pivot pin;

e) a control pin inserted rotatably into the control pin hole for controlling an axial movement of the pivot pin depending on a rotated position thereof;

wherein the control pin comprises:

a head exposed outside of the control pin hole;

a projection of a predetermined height protruded from a point of the circumference of the head a cylinder portion extended from the head in its axial direction and having a cut portion formed by cuffing out a portion thereof.

11. The door hinge device according to claim 10, wherein the diameter of the cylinder portion is equal to or less than the depressed diameter of the latching groove of the pivot pin.

12. The door hinge device according to claim 10, wherein the control pin hole has a first stopper formed on one side thereof for designating a first rotation position of the projection, which rotates integrally with the head.

13. The door hinge device according to claim 12, wherein the control pin hole has a second stopper formed on another side thereof for designating a second rotation position of the projection, which rotates integrally with the head.

14. The door hinge device according to claim 10, wherein the control pin hole has a projection guide face formed at one side thereof, the projection guide face being depressed so as to have a diameter larger than a revolution diameter of the projection, a first rotation position is defined by a release stopper formed at one position on the circumference of the projection guide face for detaching and releasing the pivot pin, and a second rotation position is defined by a locking stopper formed at another position on the circumference of the projection guide face for locking the pivot pin.

15. The door hinge device according to claim 14, wherein the cut portion is oriented towards the pivot pin hole, when the projection is placed at the position of the release stopper.

* * * * *